US008599076B2

(12) United States Patent
Yokoo

(10) Patent No.: US 8,599,076 B2
(45) Date of Patent: Dec. 3, 2013

(54) RADIO WAVE RECEIVER AND METHOD FOR PRODUCING RADIO WAVE RECEIVER

(75) Inventor: Kazumasa Yokoo, Higashiyamato (JP)

(73) Assignee: Casio Computer Co., Ltd., Tokyo (JP)

( * ) Notice: Subject to any disclaimer, the term of this patent is extended or adjusted under 35 U.S.C. 154(b) by 202 days.

(21) Appl. No.: 13/338,430

(22) Filed: Dec. 28, 2011

(65) Prior Publication Data

US 2012/0162029 A1 Jun. 28, 2012

(30) Foreign Application Priority Data

Dec. 28, 2010 (JP) ..... 2010-292179
Dec. 14, 2011 (JP) ..... 2011-273273

(51) Int. Cl.
*H01Q 1/24* (2006.01)

(52) U.S. Cl.
USPC ..... 343/702; 343/718; 368/10

(58) Field of Classification Search
USPC ..... 343/702, 718; 368/10
See application file for complete search history.

(56) References Cited

U.S. PATENT DOCUMENTS 4,754,285 A * 6/1988 Robitaille ..... 343/718
5,696,518 A * 12/1997 Itoh et al. ..... 343/718
5,798,984 A * 8/1998 Koch ..... 368/10
6,373,439 B1 * 4/2002 Zurcher et al. ..... 343/718
7,151,496 B2 * 12/2006 Casagrande et al. ..... 343/718
7,215,600 B1 * 5/2007 DeRosa et al. ..... 368/10
7,333,063 B2 * 2/2008 Yano et al. ..... 343/702
2006/0055084 A1 3/2006 Yamaguchi et al.

FOREIGN PATENT DOCUMENTS

| | | |
|---|---|---|
| CN | 2004-340186 | 12/2004 |
| JP | 2006-112866 | 4/2006 |
| JP | 2008-082722 | 4/2008 |
| JP | 2008-304485 | 12/2008 |

OTHER PUBLICATIONS

Notification of the First Office Action for Chinese Patent Application No. 201110446757.X Dated Apr. 2, 2013, 17 pgs.

* cited by examiner

*Primary Examiner* — Tho G Phan
(74) *Attorney, Agent, or Firm* — Turocy & Watson, LLP

(57) ABSTRACT

The radio wave receiver includes the antenna. The device body and the closing member are coupled to each other by making the screw portion of the fixation screw being inserted through the through-hole of the metallic closing member engage with the screw portion of the device body. The coupling resin member having electrically insulating property is coupled to the irregularities of a nanometer size formed on a metal surface of the closing member, a through-hole is formed in the coupling resin member, and thereby electrical insulation between the metallic device body and the metallic closing member which are screwed together with the fixation screw is ensured so as to improve receiving sensitivity of the antenna.

6 Claims, 3 Drawing Sheets

RADIO WAVE RECEIVER AND METHOD FOR PRODUCING RADIO WAVE RECEIVER

CROSS-REFERENCE TO RELATED APPLICATIONS

This application is based upon and claims the benefit of priority from the prior Japanese Patent Application No. 2010-292179 filed on Dec. 28, 2010, and the prior Japanese Patent Application No. 2011-273273 filed on Dec. 14, 2011, the entire contents of which are incorporated herein by reference.

BACKGROUND OF THE INVENTION

1. Field of the Invention

The present invention relates to a radio wave receiver, and a method for producing a radio wave receiver.

2. Description of the Related Art

As a radio wave receiver, there has been known a radio-controlled timepiece which includes an antenna to receive a standard radio wave (standard time and frequency signal) containing time data inside the receiver, wherein the time is corrected based upon the standard radio wave received by the antenna.

In the case that such radio-controlled timepiece includes a case body and a rear case which are made of a metal, when the case body and the rear case are electrically connected to each other, an electric current circulating in the case body and the rear case increases, entailing a problem of a significant deterioration in the receiving sensitivity of the antenna. In view of this, a radio-controlled timepiece described below has been developed (e.g., see Japanese Patent Application Laid-Open Publication No. 2006-112866). Specifically, an insulating member or a spacer member having a large electrical resistance is provided between a metallic case body and a metallic rear case for avoiding a contact between the case body and the rear case. With this structure, an electric current circulating in the case body and the rear case is suppressed for preventing the deterioration in the receiving sensitivity of the antenna.

The metallic case body and the metallic rear case would be electrically connected to each other not only in the case where the case body and the rear case directly contact with each other, but also the case where the case body and the rear case are screwed with a metallic fixation screw. This is because the case body and the fixation screw are electrically connected and the fixation screw and the rear case are electrically connected, resulting in that the case body and the rear case might be electrically connected to each other.

In view of this, a radio-controlled wrist timepiece described below has recently been known (e.g., see Japanese Patent Application Laid-Open Publication No. 2008-82722). Specifically, an insulating member having a large electrical resistance is provided between a metallic case body and a metallic rear case, and a metallic fixation screw, on a surface of which an insulating member (insulating coat film) is formed, is used for fixing the rear case to the case body.

However, in the case of this radio-controlled timepiece, the fixation screw is rubbed with the case body and the rear case when the fixation screw is fastened, so that the insulating coat film formed on the fixation screw might be destroyed. As a result, the case body and the rear case might become electrically conductive through the destroyed portion of the insulating coat film on the fixation screw.

SUMMARY OF THE INVENTION

The object of the present invention is to provide a radio wave receiver which can more surely establish an electrical insulation between a metallic device body and a metallic closing member which are connected to each other with a fixation screw, and a method for producing the radio wave receiver.

In order to achieve the above object, a radio wave receiver according to the present invention includes: a cylindrical metallic device body which includes a first screw portion; a metallic first closing member which closes an opening at a first end of the device body; a second closing member which closes an opening at a second end of the device body and which has radio wave permeability; a fixation screw which includes a second screw portion and a head portion to fasten the device body and the first closing member; and an antenna arranged in the device body. The second screw portion of the fixation screw is engaged with the first screw portion of the device body in a state that the second screw portion is inserted into a through-hole formed in the first closing member. A coupling resin member having electrically insulating property is disposed between the fixation screw and the through-hole, the coupling resin member being coupled to the first closing member through a great number of irregularities of a nanometer size formed on a wall surface of the through-hole, and the coupling resin member including an insertion hole through which the second screw portion of the fixation screw is inserted and a wall surface with which the head portion of the fixation screw is in contact.

According to the present invention, an insertion hole for the second screw portion of the fixation screw is formed in a coupling resin member having electrically insulating property. Therefore, the coupling resin member inhibits the conduction between a first closing member (e.g., rear case) and the second screw portion, which prevents the electrical connection between the device body and the first closing member via the second screw portion. By this, it becomes possible to more surely establish an electrical insulation between the metallic device body and the metallic closing member, while improving a receiving sensitivity of antenna.

BRIEF DESCRIPTION OF THE SEVERAL VIEWS OF THE DRAWINGS

The present invention will sufficiently be understood by the following detailed description and accompanying drawing, but they are provided for illustration only, and not for limiting the scope of the invention.

DETAILED DESCRIPTION OF THE INVENTION

Figure 1:
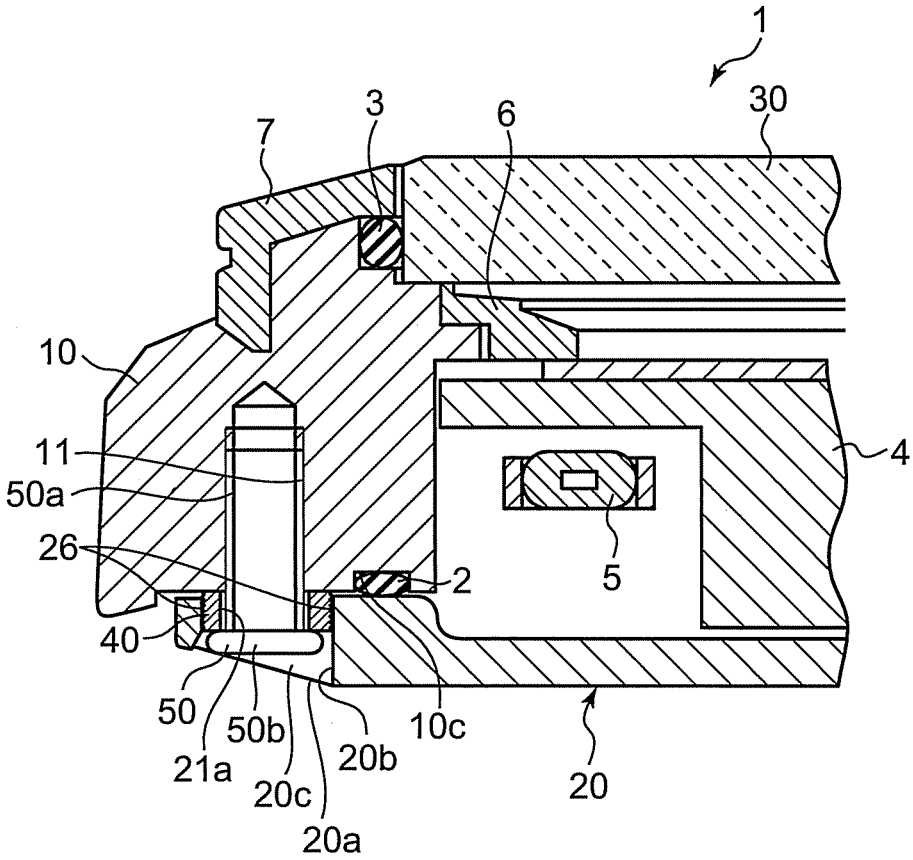
FIG. 1 is a sectional view illustrating a part of a radio-controlled timepiece according to the present invention.

FIG. 1 is a sectional view illustrating a part of a radio-controlled timepiece according to a first embodiment of the present invention.

A radio-controlled timepiece 1 includes a case body 10 which is a cylindrical device body, a rear case 20 as a first closing member, and a timepiece glass 30 as a second closing member. An opening at a lower end (first end) of the case body 10 is closed by the rear case 20, while an opening at an upper end (second end) of the case body 10 is closed by the timepiece glass 30 having radio wave permeability. A seal member 2 is interposed between the case body 10 and the rear case 20, while a seal member 3 is interposed between the case body 10 and the timepiece glass 30. With this structure, water-proof property in the case body 10 is secured.

Inside the case body 10 including first screw portions 11, a timepiece module 4, an antenna 5 for receiving a standard radio wave containing time data, a corner end member 6, and not illustrated dials, hands, and so on are housed.

On the other hand, a decorative bezel 7 is mounted on the outer side of the case body 10.

The rear case 20 is fastened (coupled) to the case body 10 by using a fixation screw 50. The fixation screw 50 includes a second screw portion 50*a* and a head portion 50*b*. The second screw portion 50*a* of the fixation screw 50 is a male screw.

The case body 10 is made of a metal, such as titanium, and is formed into a cylindrical shape. An annular groove 10*c* for mounting the seal member 2 is formed in a lower end face of the case body 10. Four first screw portions 11 are formed in the lower end surface of the case body 10 at predetermined intervals in the circumferential direction. Each of the first screw portions 11 is a female screw.

The rear case 20 will next be described.

Figure 2A:
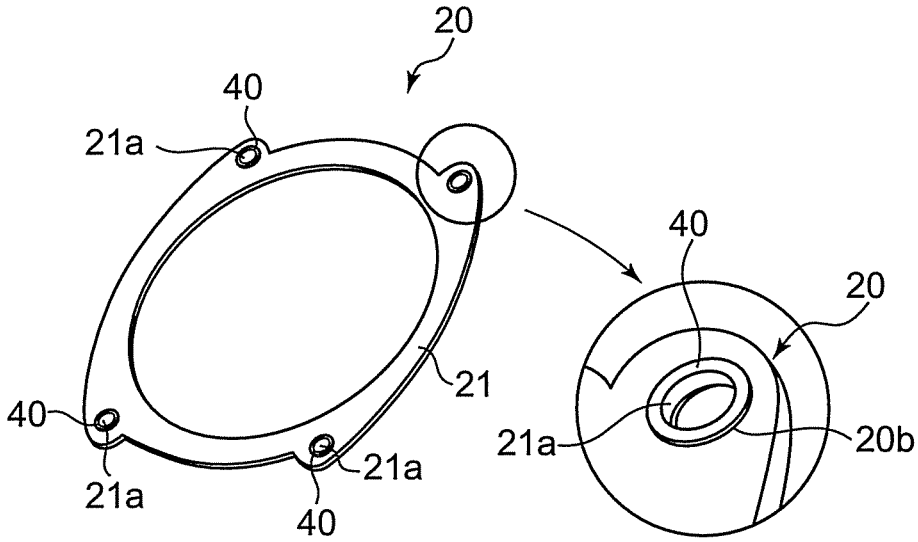
FIG. 2A is a perspective view illustrating a rear case with a coupling resin member in the radio-controlled timepiece in FIG. 1, wherein the rear case is viewed from an inner surface.
Figure 2B:
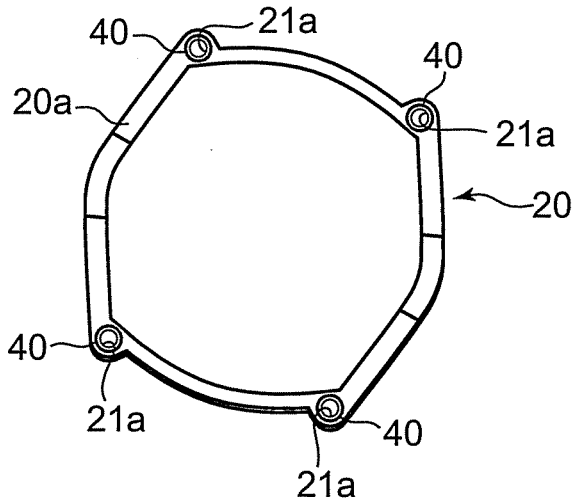
FIG. 2B is a perspective view illustrating the rear case with the coupling resin member in the radio-controlled timepiece in FIG. 1, wherein the rear case is viewed from an outer surface.

FIGS. 2A and 2B illustrate the rear case 20 with a coupling resin member 40 in the radio-controlled timepiece 1, wherein FIG. 2A illustrates the rear case 20 as viewed from an inner surface thereof, and FIG. 2B illustrates the rear case 20 as viewed from an outer surface thereof.

The rear case 20 is made of a metal, such as titanium, and is formed into a plate-like shape. A tilt surface 20*a* is formed on a peripheral edge of the outer surface of the rear case 20. Four through-holes 20*b* are formed in the tilt surface 20*a* at predetermined intervals in the circumferential direction. The diameter of each of the through-holes 20*b* is set to be larger than the diameter of the head portion 50*b* of the fixation screw 50. The four through-holes 20*b* are formed at positions corresponding to the four first screw portions 11 in the case body 10 on a one-to-one basis.

On a wall surface of each of the through-holes 20*b*, a great number of irregularities 26 of a nanometer size are formed. A cylindrical coupling resin member 40 is mounted in each of the through-holes 20*b*. The nanometer size means the size of 10 to 300 nm. In the present embodiment, a diameter of each ultrafine hole of the great number of irregularities 26 is within the range of 10 to 100 nm. Alternatively, the diameter of the ultrafine hole of the present invention can be within the range of 20 to 300 nm, or the range of 20 to 30 nm, for example.

An outer periphery of the coupling resin member 40 has a shape fitted to the through-hole 20*b*. The outer peripheral wall surface of the coupling resin member 40 is coupled to the wall surface of the through-hole 20*b* via the great number of irregularities 26. On the other hand, an insertion hole 21*a* is formed at the center of the coupling resin member 40.

The coupling resin member 40 is located at an inside upper part of the through-hole 20*b*. In other words, a lower end of the coupling resin member 40 is located at the inside of the through-hole 20*b*. As a result, a counterbore 20*c* is formed by the wall surface of the through-hole 20*b* and the lower wall surface (end face) of the coupling resin member 40. The counterbore 20*c* is the place where the head portion 50*b* of the fixation screw 50 is set on.

The depth of the counterbore 20*c* is larger than the thickness of the head portion 50*b* of the fixation screw 50. As a result, when the head portion 50*b* of the fixation screw 50 is set on the counterbore 20*c*, the head portion 50*b* does not protrude from the tilt surface 20*a* of the rear case 20. When the head portion 50*b* of the fixation screw 50 is sit on the counterbore 20*c*, a bottom wall surface of the head portion 50*b* is in contact with the lower wall surface of the coupling resin member 40.

An upper end of the coupling resin member 40 slightly protrudes from an upper surface (inner surface) of the rear case 20. This protruding portion of the coupling resin member 40 is in contact with the lower surface of the case body 10 so as to prevent the contact between the case body 10 and the rear case 20, when the rear case 20 is fastened to the case body 10. In this regard, however, the protruding portion may not be provided. This is because the contact between the case body 10 and the rear case 20 can be avoided even by the insulating seal member 2. In order to surely avoid the contact between the case body 10 and the rear case 20, the protruding portion is preferably provided.

Subsequently, a production method of the rear case 20 provided with the coupling resin member 40, particularly, a method of coupling the coupling resin member 40 to the rear case 20 will be described. This production method uses an integral molding technique with an injection molding of a metallic member and a resin member. Specifically, this production method employs a technique in which fine irregularities of a nanometer size are formed on a metal surface with a surface treatment to the metallic member, and a hard resin is filled in the irregularities by the injection molding technique so as to integrate the metallic member and the resin member. This technique is well known, so that it will not be described.

Figure 3A:
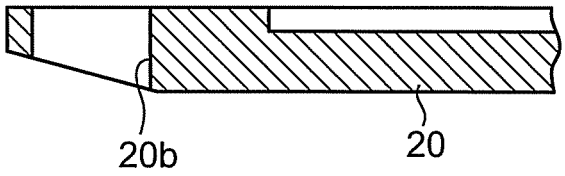
FIG. 3A is a sectional view illustrating a procedure for producing the rear case with the coupling resin member shown in FIG. 2, and illustrating a main part of the rear case.

Firstly, the rear case 20 formed with through-holes 20*b* at four portions is prepared as illustrated in FIG. 3A. The rear case 20 is preferably made of at least one type of a metal selected from a group consisting of titanium, aluminum, nickel, iron, manganese, copper, molybdenum, cobalt, tungsten, magnesium, and an alloy which contains at least one of these metal elements. The iron alloy contains a stainless steel (SUS304, SUS316L, SUS316F), for example, the titanium contains pure Ti (titanium), for example, and the titanium alloy contains 64 titanium alloy, for example. The 64 titanium alloy (alloy containing about 6% of aluminum, about 4% of vanadium, and about 90% of titanium) is more preferable out of these metal materials. It is preferable that the case body 10 is made of the metal material same as that for the rear case body 21.

The through-hole 20*b* in the rear case 20 is then immersed into an alkali solution, undergoes a defatting process, and then, immersed into an acid solution to be neutralized and cleaned.

Figure 3B:
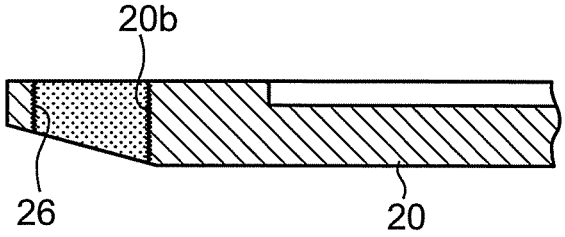
FIG. 3B is a sectional view illustrating the procedure for producing the rear case with the coupling resin member shown in FIG. 2, and illustrating a main part of the rear case on which a great number of irregularities are formed.

Subsequently, the rear case 20 is immersed into corrosive solution so as to form a great number of irregularities 26 of a nano-level size on the inner surface of the through-hole 20*b*, as illustrated in FIG. 3B. The diameter and depth of each hollow constituting the great number of irregularities 26 are about 20 nanometers in the present embodiment. However, the diameter and depth thereof are not limited thereto, and they may have another size.

Thereafter, the rear case 20 is washed with water, and dried by a dryer. Hydrazine, ammonium, aqueous amines, alkaline-earth metal hydroxide, and the like is used as the corrosive aqueous solution or corrosive suspension for forming the irregularities 26 of a nano-level size, but it is not limited thereto.

Figure 3C:
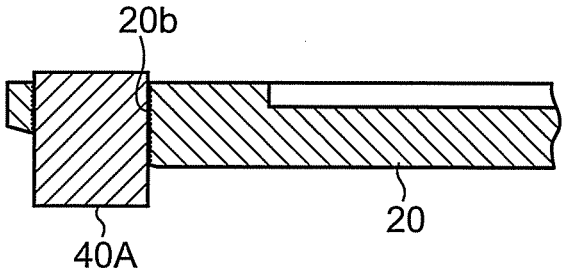
FIG. 3C is a sectional view illustrating the procedure for producing the rear case with the coupling resin member shown in FIG. 2, and illustrating a main part of the rear case on which a coupling resin block is formed.

Next, a molding resin is filled into the through-hole 20*b* by an injection molding so as to form a columnar resin block 40A therein as illustrated in FIG. 3C. An upper end of the resin block 40A with this state protrudes from the top surface (inner surface) of the rear case 20.

As the molding resin in this case, polyphenylene sulfide (PPS) is used, for example.

The polyphenylene sulfide (PPS) is used alone, or it is used as a mixture of (A) a resin composition containing 70 to 99 wt. % of polyphenylene sulfide and 1 to 30 wt. % of polyolefin resin, and (B) a resin composition containing 70 to 99 wt. % of polyphenylene sulfide, and 1 to 30 wt. % of one or more polyolefin resins selected from maleic anhydride modified ethylene copolymer, glycidyl methacrylate-modified ethylene copolymer, glycidyl ether-modified ethylene copolymer, and ethylene-alkyl acrylate copolymer.

In the present embodiment, the polyphenylene sulfide (PPS) is used as the molding resin. However, the molding resin is not limited thereto. For example, a material containing 20% of glass fiber into the polyphenylene sulfide (PPS), or polyether imide (PEI), polyether ketone (PEEK), polyamide imide (PAI), or polyarylate (AXG) may be used.

Figure 3D:
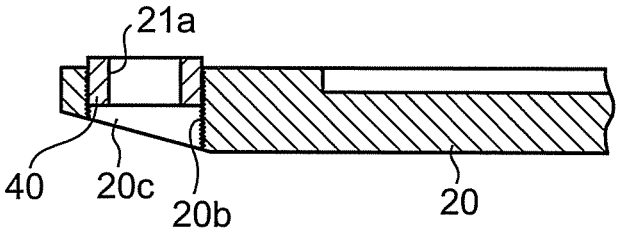
FIG. 3D is a sectional view illustrating the procedure for producing the rear case with the coupling resin member shown in FIG. 2, and illustrating a main part of the rear case with the coupling resin member.

Next, as illustrated in FIG. 3D, an lower part of the resin block 40A is cut to form the counterbore 20*c* into which the head portion 50*b* of the fixation screw 50 is housed, and further, the insertion hole 21*a* is formed at the center of the resin block 40A with a drill and the like, whereby the coupling resin member 40 is formed. Thus, the rear case 20 provided with the coupling resin member 40 is produced.

The great number of irregularities 26 is formed on the inner surface of the through-hole 20*b* in such a manner that corrosive solution is selectively supplied only to the through-hole 20*b* by using a jig, or in such a manner that the whole rear case 20 is immersed into the corrosive solution. When the whole rear case 20 is immersed into the corrosive solution, the irregularities are formed on the portion other than the inner surface of the through-hole 20*b*. Therefore, it is preferable that the unnecessary irregularities are removed by polishing.

The radio-controlled timepiece 1 according to the first embodiment can provide effects as described below.

Specifically, when the rear case 20 is fastened to the case body 10, the coupling resin member 40 is arranged between the fixation screw 50 and the rear case 20. Therefore, the fixation screw 50 and the rear case 20 can surely be electrically insulated from each other. Accordingly, this structure prevents the electrical conduction between the case body 10 and the rear case 20 through the second screw portion 50*a*.

Since the depth of the counterbore 20*c* formed in the rear case 20 is larger than the thickness of the head portion 50*b* of the fixation screw 50, the head portion 50*b* does not protrude from the outer surface of the rear case 20 when the head portion 50*b* of the fixation screw 50 is sit on the counterbore 20*c*. Therefore, a good-looking radio-controlled timepiece 1 can be realized.

Since the coupling resin member 40 near the case body 10 protrudes from the inner surface of the rear case 20, the contact between the case body 10 and the rear case 20 can surely be prevented. This structure also prevents the electrical connection between the case body 10 and the rear case 20.

As described above, according to the present embodiment, a radio wave receiver includes: a cylindrical metallic device body 10 which includes a first screw portion 11; a metallic first closing member 20 which closes an opening at a first end of the device body 10; a second closing member 30 which closes an opening at a second end of the device body 10 and which has radio wave permeability; a fixation screw 50 which includes a second screw portion 50*a* and a head portion 50*b* to fasten the device body 10 and the first closing member 20; and an antenna 5 arranged in the device body. The second screw portion 50*a* of the fixation screw 50 is engaged with the first screw portion 11 of the device body 10 in a state that the second screw portion 50*a* is inserted into a through-hole 20*b* formed in the first closing member 20. A coupling resin member 40 having electrically insulating property is disposed between the fixation screw 50 and the through-hole 20*b*, the coupling resin member 40 being coupled to the first closing member 20 through a great number of irregularities 26 of a nanometer size formed on a wall surface of the through-hole 20*b*, and the coupling resin member 40 including an insertion hole 21*a* through which the second screw portion 50*a* of the fixation screw 50 is inserted and a wall surface with which the head portion 50*b* of the fixation screw 50 is in contact.

Preferably, the through-hole 20*b* has a size capable of accepting the head portion 50*b*.

Preferably, the wall surface of the through-hole 20*b* and an end face of the coupling resin member 40 forms a counterbore 20*c* whose depth is larger than a thickness of the head portion 50*b* of the fixation screw 50 so that the head portion 50*b* sits on the counterbore 20*c*.

Preferably, the coupling resin member 40 protrudes from an inner surface of the first closing member 20.

Preferably, the device body 10 is a case body, the first closing member 20 is a rear case, and the second closing member 30 is a timepiece glass.

Meanwhile, according to the present embodiment, a method for producing a radio wave receiver which includes: a cylindrical metallic device body 10 which includes a first screw portion 11; a metallic first closing member 20 which closes an opening at a first end of the device body 10; a second closing member 30 which closes an opening at a second end of the device body 10 and which has radio wave permeability; a fixation screw 50 which includes a second screw portion 50*a* and a head portion 50*b* to fasten the device body 10 and the first closing member 20; and an antenna arranged in the device body 10, the method includes the steps of: forming a great number of irregularities 26 of a nanometer size on a wall surface of a through-hole 20*b* of the first closing member 20; coupling a resin block 40A having electrically insulating property to the first closing member 20 through the irregularities 26 with an injection molding; and forming an insertion hole 21*a* in the resin block 40A, through which hole the second screw portion 50*a* of the fixation screw 50 is inserted.

The embodiment of the present invention has been described above. However, the present invention is not limited thereto, and various modifications are possible without departing from the scope of the invention.

For example, in the radio-controlled timepiece in the above-mentioned embodiment, the case body 10, the rear case 20, and so on are made of titanium. However, the present invention is applicable to a radio-controlled timepiece in which the case body 10, the rear case 20, and so on are made of an aluminum member, an aluminum alloy member, a magnesium member, a magnesium alloy member, a copper member, a copper alloy member, a titanium alloy member, a stainless member, an iron member, or a brass member.

As the molding resin, Polybutylene terephthalate (PBT), polyamide (nylon PA6, PA66), or polyphthalamide (PPA) can be used.

As a filling agent added to the molding resin, a glass fiber, carbon fiber, aramide fiber, calcium carbonate, silica, talc, clay, or glass can be used. However, it is not limited thereto.

The present invention is applied to a radio-controlled timepiece in the above-mentioned embodiment. However, the present invention can be applied to other radio wave receivers.

What is claimed is:

1. A radio wave receiver comprising:

a cylindrical metallic device body which includes a first screw portion;

a metallic first closing member which closes an opening at a first end of the device body;

a second closing member which closes an opening at a second end of the device body and which has radio wave permeability;

a fixation screw which includes a second screw portion and a head portion to fasten the device body and the first closing member; and an antenna arranged in the device body, wherein the second screw portion of the fixation screw is engaged with the first screw portion of the device body in a state that the second screw portion is inserted into a through-hole formed in the first closing member, wherein a coupling resin member having electrically insulating property is disposed between the fixation screw and the through-hole, the coupling resin member being coupled to the first closing member through a great number of irregularities of a nanometer size formed on a wall surface of the through-hole, and the coupling resin member including an insertion hole through which the second screw portion of the fixation screw is inserted and a wall surface with which the head portion of the fixation screw is in contact.

2. The radio wave receiver according to claim 1, wherein the through-hole has a size capable of accepting the head portion.

3. The radio wave receiver according to claim 2, wherein the wall surface of the through-hole and an end face of the coupling resin member forms a counterbore whose depth is larger than a thickness of the head portion of the fixation screw so that the head portion sits on the counterbore.

4. The radio wave receiver according to claim 1, wherein the coupling resin member protrudes from an inner surface of the first closing member.

5. The radio wave receiver according to claim 1, wherein the device body is a case body, the first closing member is a rear case, and the second closing member is a timepiece glass.

6. A method for producing a radio wave receiver which includes: a cylindrical metallic device body which includes a first screw portion; a metallic first closing member which closes an opening at a first end of the device body; a second closing member which closes an opening at a second end of the device body and which has radio wave permeability; a fixation screw which includes a second screw portion and a head portion to fasten the device body and the first closing member; and an antenna arranged in the device body, the method comprising the steps of:

forming a great number of irregularities of a nanometer size on a wall surface of a through-hole of the first closing member;

coupling a resin block having electrically insulating property to the first closing member through the irregularities with an injection molding; and forming an insertion hole in the resin block, through which hole the second screw portion and an axial portion of the fixation screw is inserted.

* * * * *